US011699546B2

(12) United States Patent
Li et al.

(10) Patent No.: US 11,699,546 B2
(45) Date of Patent: Jul. 11, 2023

(54) COIL COMPONENT

(71) Applicant: SAMSUNG ELECTRO-MECHANICS CO., LTD., Suwon-si (KR)

(72) Inventors: Yong Hui Li, Suwon-si (KR); Byung Soo Kang, Suwon-si (KR); Byeong Cheol Moon, Suwon-si (KR); Ju Hwan Yang, Suwon-si (KR); Seung Min Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 570 days.

(21) Appl. No.: 16/867,865

(22) Filed: May 6, 2020

(65) Prior Publication Data

US 2021/0035728 A1 Feb. 4, 2021

(30) Foreign Application Priority Data

Jul. 29, 2019 (KR) ..... 10-2019-0091563

(51) Int. Cl.
*H01F 27/28* (2006.01)
*H01F 27/32* (2006.01)
(Continued)

(52) U.S. Cl.
CPC ..... *H01F 27/2804* (2013.01); *H01F 27/29* (2013.01); *H01F 27/32* (2013.01);
(Continued)

(58) Field of Classification Search
CPC ..... H01F 27/2804; H01F 27/29; H01F 27/32; H01F 41/041; H01F 41/12; H01F 2027/2809
(Continued)

(56) References Cited

U.S. PATENT DOCUMENTS

2003/0137384 A1* 7/2003 Itou ..... H05K 1/165 336/200
2003/0141952 A1* 7/2003 Moro ..... H01F 41/0246 336/90
(Continued)

FOREIGN PATENT DOCUMENTS

CN 110706901 A * 1/2020 ..... H01F 17/04
CN 109390138 B * 5/2022 ..... H01F 17/0013
(Continued)

OTHER PUBLICATIONS

Office Action issued in corresponding Korean Patent Application No. 10-2019-0091563 dated Jul. 20, 2020, with English translation.

*Primary Examiner* — Suresh Memula
(74) *Attorney, Agent, or Firm* — Morgan, Lewis & Bockius LLP

(57) ABSTRACT

A coil component includes a body; a supporting substrate embedded in the body; a coil portion including a coil pattern, and a lead-out pattern exposed to an outside of the body through an external surface of the body, and disposed on the supporting substrate and embedded in the body; and an insulating film disposed between the coil portion and the body, wherein at least a portion of the lead-out pattern contacts the body through an opening formed in the insulating film.

20 Claims, 10 Drawing Sheets

(51) Int. Cl.
*H01F 41/04* (2006.01)
*H01F 41/12* (2006.01)
*H01F 27/29* (2006.01)

(52) U.S. Cl.
CPC ..... *H01F 41/041* (2013.01); *H01F 41/12* (2013.01); *H01F 2027/2809* (2013.01)

(58) Field of Classification Search
USPC ..... 336/200
See application file for complete search history.

(56) References Cited

U.S. PATENT DOCUMENTS

| | | | | |
|---|---|---|---|---|
| 2005/0030143 | A9* | 2/2005 | Satoh | A61B 8/145 336/200 |
| 2015/0091685 | A1* | 4/2015 | Kitajima | H01F 17/0013 29/602.1 |
| 2015/0109088 | A1 | 4/2015 | Kim et al. | |
| 2017/0169936 | A1* | 6/2017 | Ishida | H01F 27/2804 |
| 2017/0200554 | A1* | 7/2017 | Kudo | H01F 27/36 |
| 2018/0033538 | A1* | 2/2018 | Yoon | H01F 27/2804 |
| 2018/0197672 | A1* | 7/2018 | Kim | H01F 41/041 |
| 2018/0211762 | A1* | 7/2018 | Jung | H01F 27/292 |
| 2018/0315541 | A1* | 11/2018 | Okura | H01F 27/29 |
| 2018/0374626 | A1* | 12/2018 | Jang | H01F 17/04 |
| 2019/0013148 | A1* | 1/2019 | Ohkubo | H01F 17/045 |
| 2019/0304654 | A1* | 10/2019 | Choi | H01F 17/04 |
| 2019/0326047 | A1* | 10/2019 | Yamaguchi | H01F 27/2804 |
| 2020/0013540 | A1* | 1/2020 | Kang | H01F 27/292 |

FOREIGN PATENT DOCUMENTS

| | | | | | |
|---|---|---|---|---|---|
| JP | 2003-197428 | A | | 7/2003 | |
| JP | 2006-278484 | A | | 10/2006 | |
| JP | 2020017716 | A | * | 1/2020 | H01F 17/0013 |
| KR | 10-2015-0046717 | A | | 4/2015 | |
| KR | 20180028374 | A | * | 3/2018 | |
| KR | 20200041696 | A | * | 4/2020 | |
| KR | 20200060009 | A | * | 5/2020 | |
| KR | 20200062145 | A | * | 5/2020 | |
| KR | 102118489 | B1 | * | 6/2020 | |
| KR | 20200120375 | A | * | 10/2020 | |
| KR | 102404313 | B1 | * | 6/2022 | |
| WO | WO-2013108862 | A1 | * | 7/2013 | H01F 17/0013 |

* cited by examiner

III-III'

COIL COMPONENT

CROSS-REFERENCE TO RELATED APPLICATION(S)

The present application claims the benefit of priority to Korean Patent Application No. 10-2019-0091563 filed on Jul. 29, 2019 in the Korean Intellectual Property Office, the disclosure of which is incorporated herein by reference in its entirety.

TECHNICAL FIELD

The present disclosure relates to a coil component.

BACKGROUND

An inductor, a coil component, may be a typical passive electronic component used in electronic devices, along with a resistor and a capacitor.

With higher performance and smaller sizes gradually implemented in electronic devices, the number of coil components used in electronic devices has been increasing and becoming smaller.

In the case of a conventional thin film inductor, since the body includes a metal powder as a conductor, an insulating film may be interposed between a coil and a body for electrical insulation between the coil and the body.

Meanwhile, as a relative area occupied by a lead-out pattern of the coil in the body increases, bonding force between the lead-out pattern and the body may be weakened by the above-mentioned insulating film.

SUMMARY

An aspect of the present disclosure is to provide a coil component capable of securing reliability for bonding between a coil portion and a body.

According to one exemplary embodiment of the present disclosure, a coil component includes a body; a supporting substrate embedded in the body; a coil portion including a coil pattern, and a lead-out pattern exposed to an outside of the body through an external surface of the body, and disposed on the supporting substrate and embedded in the body; and an insulating film disposed between the coil portion and the body. At least a portion of the lead-out pattern contacts the body through an opening formed in the insulating film.

According to another exemplary embodiment of the present disclosure, a coil component includes a body; a supporting substrate embedded in the body; a coil portion including a coil pattern, and a lead-out pattern exposed to an outside of the body through an external surface of the body, and disposed on the supporting substrate and embedded in the body; and an insulating film disposed between the coil portion and the body. The lead-out pattern has a first surface exposed to the outside of the body through the external surface of the body, and a second surface connected to the first surface and disposed inside the body. The insulating film does not extend to a corner portion of the second surface of the lead-out pattern connected to the first surface of the lead-out pattern.

According to another exemplary embodiment of the present disclosure, a coil component includes a body; a supporting substrate embedded in the body; a coil portion including a coil pattern, and a lead-out pattern exposed to an outside of the body through an external surface of the body, and disposed on the supporting substrate and embedded in the body; and an insulating film disposed between the coil portion and the body. The insulating film is disposed inside the body, and spaced apart from the external surface of the body.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
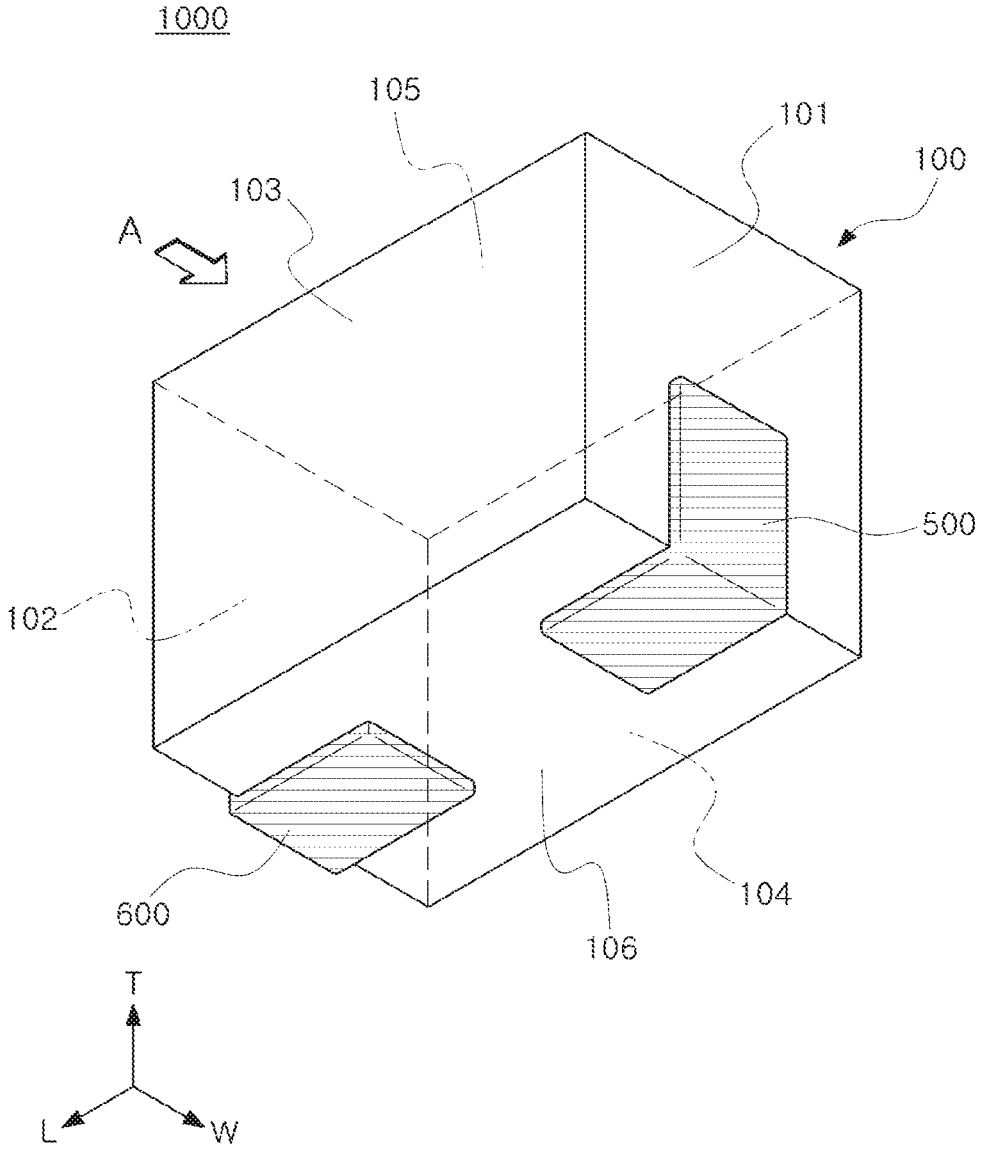
FIGS. 1 to 2 are views schematically illustrating a coil component according to an exemplary embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an L direction is a first direction or a length direction, a W direction is a second direction or a width direction, and a T direction is a third direction or a thickness direction.

Hereinafter, a coil component according to an embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, or the like.

Figure 2:
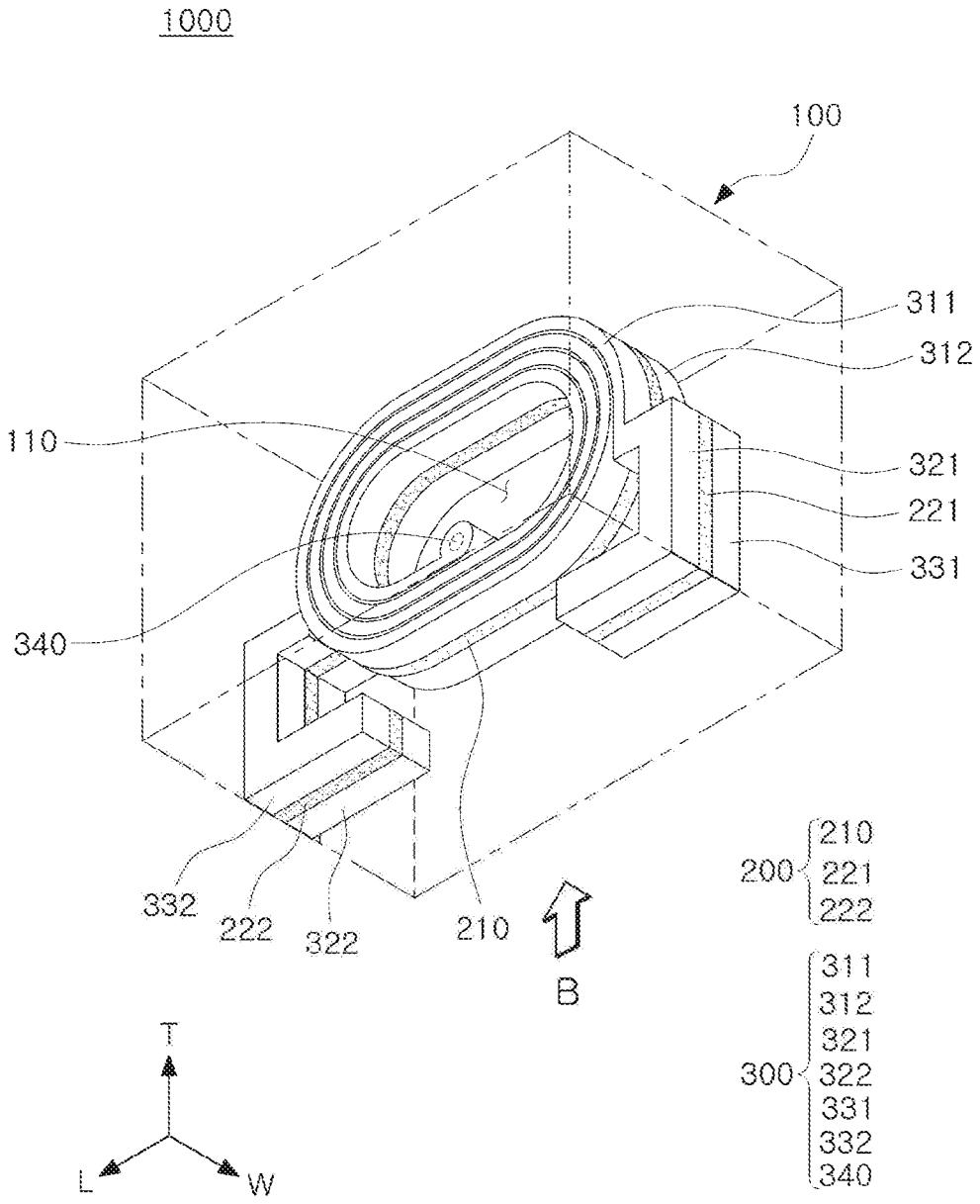
Figure 3:
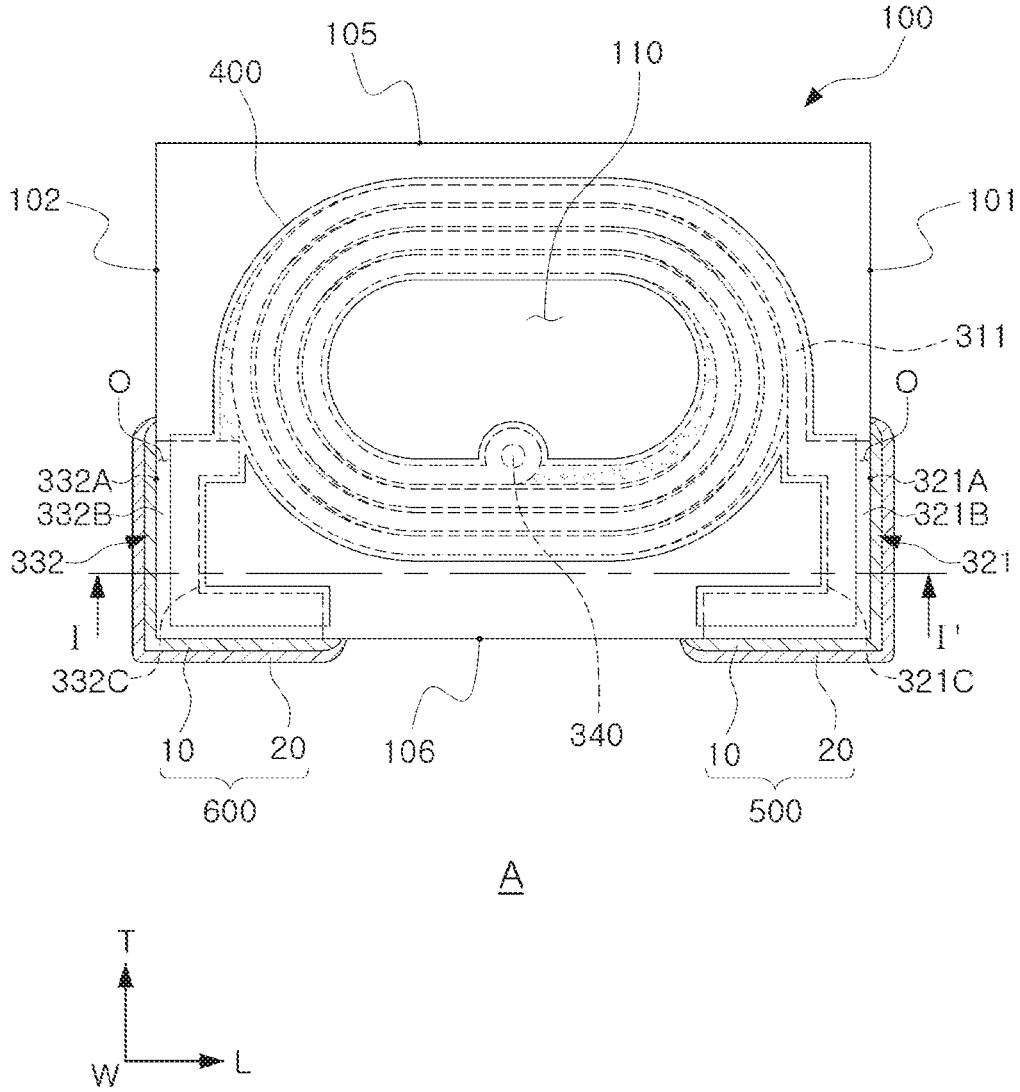
FIG. 3 is a schematic view of FIG. 1, when seen in a direction A.
Figure 4:
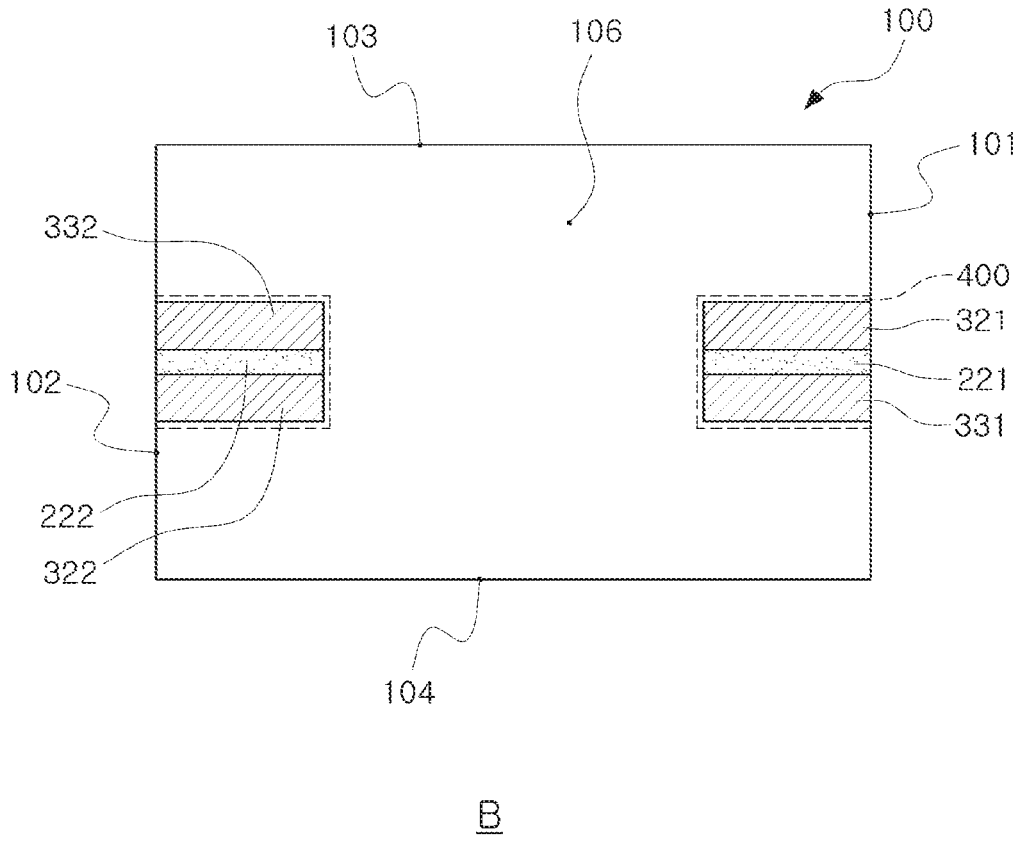
FIG. 4 is a schematic view of FIG. 2, when seen in a direction B.
Figure 5:
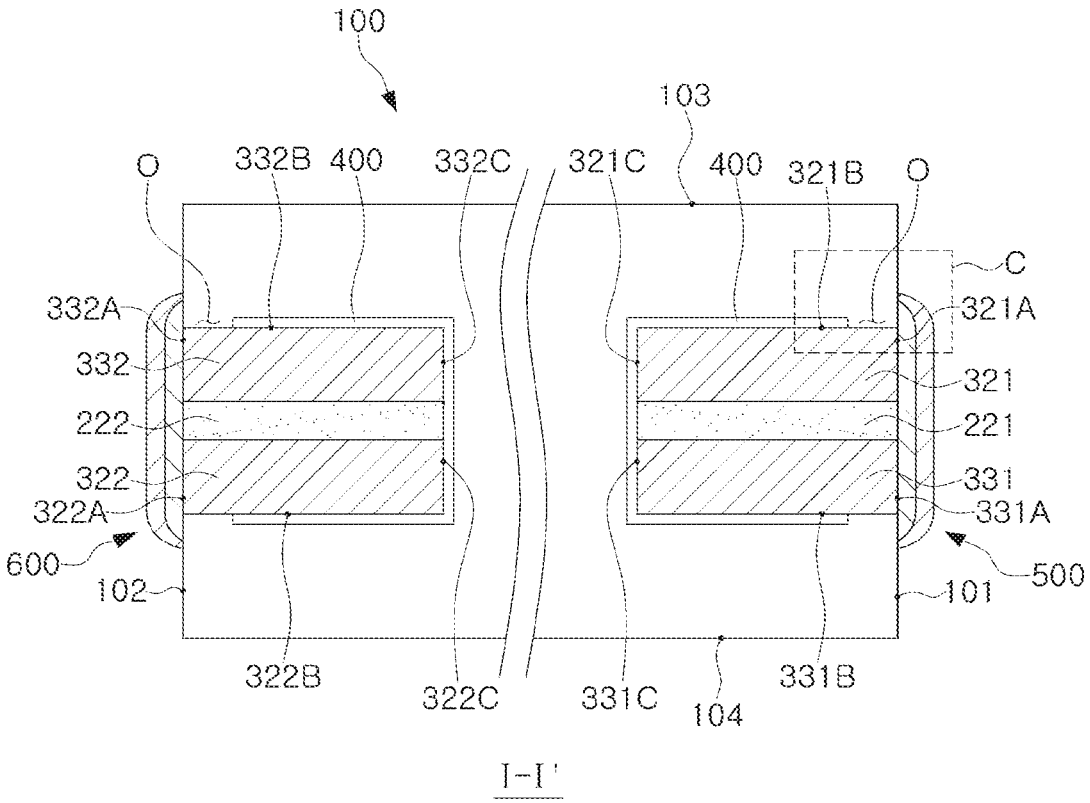
FIG. 5 is a cross-sectional view taken along line I-I' of FIG. 3.
Figure 6:
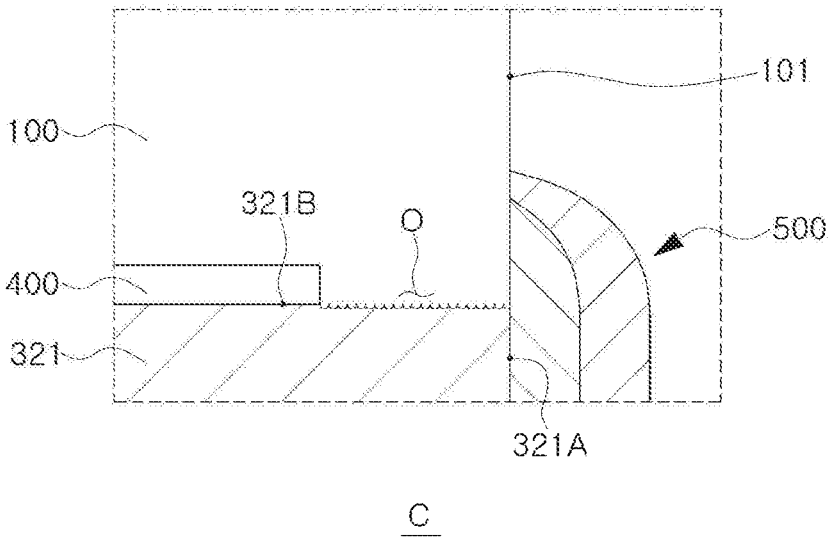
FIG. 6 is an enlarged view of region C of FIG. 5.

FIGS. 1 to 2 are views schematically illustrating a coil component according to an embodiment of the present disclosure. FIG. 3 is a schematic view of FIG. 1, when seen in a direction A. FIG. 4 is a schematic view of FIG. 2, when seen in a direction B. FIG. 5 is a cross-sectional view taken along line I-I' of FIG. 3. FIG. 6 is an enlarged view of region C of FIG. 5. Meanwhile, for clarity, FIG. 1 mainly illustrates an appearance of a coil component according to this embodiment, and FIG. 2 mainly illustrates an internal structure of a coil component according to this embodiment. In addition, for clarity, FIG. 2 omits a portion of components applied to this embodiment. In addition, for clarity, FIG. 3 mainly illustrates the internal structure of FIG. 1, when viewed in a direction A.

Referring to FIGS. 1 to 6, a coil component 1000 according to an embodiment of the present disclosure may include a body 100, a supporting substrate 200, a coil portion 300, an insulating film 400, and external electrodes 500 and 600. The supporting substrate 200 may include a support portion 210 and end portions 221 and 222. The coil portion 300 may include coil patterns 311 and 312, lead-out patterns 321 and 322, auxiliary lead-out patterns 331 and 332, and vias 340.

The body 100 may form an appearance of the coil component 1000 according to this embodiment, and may embed the coil portion 300 therein. The body 100 may include an anchor portion 120 inserted into each of first and second lead-out patterns 321 and 322 to be described later. This will be described later.

The body 100 may be formed to have a hexahedral shape overall, and may have an external surface, i.e., first to sixth surfaces 101, 102, 103, 104, 105, and 106.

Referring to FIGS. 1 and 2, the body 100 may include a first surface 101 and a second surface 102 opposing each other in a longitudinal direction L, a third surface 103 and a fourth surface 104 opposing each other in a width direction W, and a fifth surface 105 and a sixth surface 106 opposing each other in a thickness direction T. Each of the first to fourth surfaces 101, 102, 103, and 104 of the body 100 may correspond to wall surfaces of the body 100 connecting the fifth surface 105 and the sixth surface 106 of the body 100. Hereinafter, one end surface and the other end surface of the body 100 may refer to the first surface 101 and the second surface 102 of the body, respectively, and one side surface and the other side surface of the body 100 may refer to the third surface 103 and the fourth surface 104 of the body, respectively. Further, one surface and the other surface of the body 100 may refer to the sixth surface 106 and the fifth surface 105 of the body 100, respectively.

The body 100 may be formed such that the coil component 1000 according to this embodiment in which the external electrodes 600 and 700, to be described later, are formed has a length of 1.0 mm, a width of 0.6 mm, and a thickness of 0.8 mm, but is not limited thereto. Since the numerical values described above may be merely design values that do not reflect process errors and the like, they should be considered to fall within the scope of the present disclosure to the extent in which ranges may be recognized as process errors.

The body 100 may include a magnetic material and a resin. As a result, the body 100 may be magnetic. The body 100 may be formed by stacking one or more magnetic composite sheet containing a resin and a magnetic material dispersed in the resin. The body 100 may have a structure other than a structure in which the magnetic material is dispersed in the resin. For example, the body 100 may be made of a magnetic material such as ferrite.

The magnetic material may be a ferrite powder or a metal magnetic powder.

Examples of the ferrite powder may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The metal magnetic powder may include one or more selected from a group consisting of iron (Fe), silicon (Si), chromium (Cr), cobalt (Co), molybdenum (Mo), aluminum (Al), niobium (Nb), copper (Cu), and nickel (Ni). For example, the metal magnetic powder may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The metal magnetic powder may be amorphous or crystalline. For example, the metal magnetic powder may be a Fe—Si—B—Cr-based amorphous alloy powder, but is not limited thereto.

The ferrite powder and the metal magnetic powder may have an average diameter of about 0.1 μm to 30 μm, respectively, but are not limited thereto.

The body 100 may include two or more types of magnetic materials dispersed in an insulating resin. In this case, the term "different types of magnetic materials" means that magnetic materials dispersed in an insulating resin are distinguished from each other by an average diameter, a composition, crystallinity, and a shape.

The insulating resin may include an epoxy, a polyimide, a liquid crystal polymer, or the like, in a single form or in combined forms, but is not limited thereto.

The body 100 may include a core 110 passing through the coil portion 300 and the supporting substrate 200, which will be described later. The core 110 may be formed by filling through holes of the coil portion 300 with a magnetic composite sheet, but is not limited thereto.

The supporting substrate 200 may be embedded in the body 100. Specifically, the supporting substrate 200 may be embedded in the body 100 to be perpendicular to one surface 106 of the body 100. Therefore, the coil portion 300 disposed on the supporting substrate 200 may be disposed such that winding axes of the coil patterns 311 and 312 may be substantially parallel to the one surface 106 of the body 100. The supporting substrate 200 may include the support portion 210 and the end portions 221 and 222. The support portion 210 may support the first and second coil patterns 311 and 312, which will be described later. A first end portion 221 may support a first lead-out pattern 321 and a first auxiliary lead-out pattern 331. A second end portion 222 may support a second lead-out pattern 322 and a second auxiliary lead-out pattern 332.

Since the support portion 210 and the end portions 221 and 222 applied to this embodiment may be formed by processing any one material, they may be integrally formed with each other. The present disclosure is not limited thereto. For the reasons described above, one surface of the support portion 210 and one surface of the end portions 221 and 222 may be used in combination with one surface of the supporting substrate 200, the other surface of the support portion 210 and the other surface of the end portions 221 and 222 may be used in combination with the other surface of the supporting substrate 200.

The supporting substrate 200 may be formed of an insulating material including a thermosetting insulating resin such as an epoxy resin, a thermoplastic insulating resin such as polyimide, or a photosensitive insulating resin, or may be formed of an insulating material in which a reinforcing material such as a glass fiber or an inorganic filler is impregnated with such an insulating resin. For example, the supporting substrate 200 may be formed of an insulating material such as prepreg, Ajinomoto Build-up Film (ABF), FR-4, a bismaleimide triazine (BT) resin, a photoimageable dielectric (PID), a copper clad laminate (CCL), and the like, but are not limited thereto.

As the inorganic filler, at least one or more selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the supporting substrate 200 is formed of an insulating material including a reinforcing material, the supporting substrate 200 may provide better rigidity. When the supporting substrate 200 is formed of an insulating material not containing glass fibers, the supporting substrate 200 may reduce a thickness of the overall coil portion 300, to reduce a width of the coil component 1000 according to this embodiment.

The coil portion 300 may be embedded in the body 100 to manifest the characteristics of the coil portion. For example, when the coil component 1000 of this embodiment is used as a power inductor, the coil portion 300 may function to stabilize the power supply of an electronic device by storing an electric field as a magnetic field and maintaining an output voltage.

In this embodiment, the coil portion 300 may include first and second coil patterns 311 and 312 respectively arranged on both surfaces of the support portion 210 opposing each other to oppose each other, a first lead-out pattern 321 and a first auxiliary lead-out pattern 331 respectively arranged on both surfaces of a first end portion 221 to oppose each other, and a second lead-out pattern 322 and a second auxiliary lead-out pattern 332 respectively arranged on both surfaces of a second end portion 222 to oppose each other. In addition, the coil portion 300 may include a via 340 passing through the support portion 210, to connect the first and second coil patterns 311 and 312 to each other. In addition, the coil portion 300 may include a connecting via passing through the end portions 221 and 222, to connect the lead-out patterns 321 and 322 and the auxiliary lead-out patterns 331 and 332 to each other.

The coil portion 300 may be formed on at least one of both surfaces of the supporting substrate 200 opposing each other, to form at least one turn. In detail, each of the first coil pattern 311 and the second coil pattern 312 may be formed in a planar spiral shape having at least one turn about the core 110. For example, referring to FIG. 2, the first coil pattern 311 may format least one turn about the core 110 on one surface of the support portion 210 (a front surface of the support portion 210 based on the direction of FIG. 2). The second coil pattern 312 may form at least one turn about the core 110 on the other surface of the support portion 210 (a rear surface of the support portion 210 based on the direction of FIG. 2).

Referring to FIG. 2, the first lead-out pattern 321 may extend from the first coil pattern 311 to be disposed on one surface of the first end portion 221 (a front surface of the first end portion 221 based on the direction of FIG. 2), and the second lead-out pattern 322 may extend from the second coil pattern 312 to be disposed on the other surface of the second end portion 222 (a rear surface of the second end portion 222 based on the direction of FIG. 2).

The lead-out patterns 321 and 322 may include first surfaces 321A and 322A exposed from the external surface of the body 100, second surfaces 321B and 322B connected to the first surfaces 321A and 322A and disposed inside of the body 100, and third surfaces 321C and 322C connected to the second surfaces 321B and 322B and opposing the first surfaces 321A and 322A. Specifically, referring to FIGS. 2 to 6, the first lead-out pattern 321 may have a first surface 321A continuously exposed from the first surface 101 of the body 100 and the sixth surface 106 of the body 100, a third surface 321C embedded in the body 100 and opposing the first surface 321A, and a second surface 321B respectively connected to the first surface 321A and the third surface 321C. The second lead-out pattern 322 may have a first surface 322A continuously exposed from the second surface 102 of the body 100 and the sixth surface 106 of the body 100, a third surface 322C embedded in the body 100 and opposing the first surface 322A, and a second surface 322B respectively connected to the first surface 322A and the third surface 322C. As a result, the second surfaces 321B and 322B of the lead-out patterns 321 and 322 may be substantially perpendicular to the width direction W of the body 100, respectively, and may be formed in an L shape.

In the first lead-out pattern 321, the first surface 321A may be continuously exposed from the first surface 101 of the body 100 and the sixth surface 106 of the body 100. In the second lead-out pattern 322, the first surface 322A may be continuously exposed from the second surface 102 of the body 100 and the sixth surface 106 of the body 100. The external electrodes 500 and 600 to be described later may be formed to cover the first surfaces 321A and 322A, which may be exposed surfaces of the lead-out patterns 321 and 322. Since the first surfaces 321A and 322A of the lead-out patterns 321 and 322 may be exposed from the surface of the body 100 in a relatively large area, the bonding force between the lead-out pattern 321 and 322 and the external electrode 500 and 600 may increase.

Referring to FIG. 2, the first auxiliary lead-out pattern 331 may be disposed on the other surface of the first end portion 221 (the back surface of the first end portion 221 in the direction of FIG. 2) to correspond to the first lead-out pattern 321, and spaced apart from the second coil pattern 312. The first auxiliary lead-out pattern 331 and the first lead-out pattern 321 may be connected to each other by a first connecting via passing through the first end portion 221. The second auxiliary lead-out pattern 332 may be disposed on the one surface of the second end portion 222 (the front surface of the second end portion 222 in the direction of FIG. 2) to correspond to the second lead-out pattern 322, and spaced apart from the first coil pattern 311. The second auxiliary lead-out pattern 332 and the second lead-out pattern 322 may be connected to each other by a second connecting via passing through the second end portion 222.

The auxiliary lead-out patterns 331 and 332 may include first surfaces 331A and 332A exposed from the external surface of the body 100, second surfaces 331B and 332B connected to the first surfaces 331A and 332A and disposed inside of the body 100, and third surfaces 331C and 332C connected to the second surfaces 331B and 332B and opposing the first surfaces 331A and 332A. Specifically, referring to FIGS. 2 to 6, the first auxiliary lead-out pattern 331 may have a first surface 331A continuously exposed from the first surface 101 of the body 100 and the sixth surface 106 of the body 100, a third surface 331C embedded in the body 100 and opposing the first surface 331A, and a second surface 331B respectively connected to the first surface 331A and the third surface 331C. The second lead-out pattern 332 may have a first surface 332A continuously exposed from the second surface 102 of the body 100 and the sixth surface 106 of the body 100, a third surface 332C embedded in the body 100 and opposing the first surface 332A, and a second surface 332B respectively connected to the first surface 332A and the third surface 332C. As a result, the second surfaces 331B and 332B of the auxiliary lead-out patterns 331 and 332 may be substantially perpendicular to the width direction W of the body 100, respectively, and may be formed to have an L shape.

In the first auxiliary lead-out pattern 331, the first surface 331A may be continuously exposed from the first surface 101 of the body 100 and the sixth surface 106 of the body 100. In the second auxiliary lead-out pattern 332, the first surface 332A may be continuously exposed from the second surface 102 of the body 100 and the sixth surface 106 of the body 100. The external electrodes 500 and 600 to be described later may be formed to cover the first surfaces 331A and 332A, which may be exposed surfaces of the auxiliary lead-out patterns 331 and 332. Since the first surfaces 331A and 332A of the auxiliary lead-out patterns 331 and 332 may be exposed from the surface of the body 100 in a relatively large area, the bonding force between the auxiliary lead-out patterns 331 and 332 and the external electrodes 500 and 600 may increase. In addition, the bonding force between the external electrodes 500 and 600, except for the coil portion 300, may be further improved due to the auxiliary lead-out patterns 331 and 332.

Since the first coil pattern 311 and the first lead-out pattern 321 may be integrally formed, no boundary therebetween may occur. Since the second coil pattern 312 and the second lead-out pattern 322 may be integrally formed, no boundary therebetween may occur. The above descriptions are merely illustrative, but the present disclosure is not limited to the case in which the above-described structures are formed at different operations to occur a boundary therebetween.

At least one of the coil patterns 311 and 312, the lead-out patterns 321 and 322, the auxiliary lead-out patterns 331 and 332, and the vias 340 may include at least one conductive layer.

For example, when the first coil pattern 311, the first lead-out pattern 321, the second auxiliary lead-out pattern 332, and the via 340 are formed on one surface of the supporting substrate 200 by a plating process, each of the coil pattern 311, the first lead-out pattern 321, the second auxiliary lead-out pattern 332, and the via 340 may include a seed layer and an electroplating layer. The seed layer may be formed by a vapor deposition method such as electroless plating, sputtering, or the like. Each of the seed layer and the electroplating layer may have a single-layer structure or a multilayer structure. The electroplating layer of the multilayer structure may be formed by a conformal film structure in which one electroplating layer is covered by the other electroplating layer, or may have a form in which the other electroplating layer is stacked on only one surface of the one electroplating layer. The seed layer of the first coil pattern 311 and the seed layer of the via 340 may be integrally formed, no boundary therebetween may occur, but are not limited thereto. The electroplating layer of the first coil pattern 311 and the electroplating layer of the via 340 may be integrally formed, no boundary therebetween may occur, but are not limited thereto.

Each of the coil patterns 311 and 312, the lead-out patterns 321 and 322, the auxiliary lead-out patterns 331 and 332, and the vias 340 may be formed of a conductive material such as copper (Cu), aluminum (Al), silver (Ag), tin (Sn), gold (Au), nickel (Ni), lead (Pb), titanium (Ti), chromium (Cr), and molybdenum (Mo), or alloys thereof, but are not limited thereto.

The insulating film 400 may be disposed between each of the supporting substrate 200 and the coil portion 300 and the body 100. In this embodiment, since the body 100 may include the metal magnetic powder, the insulating film 400 may be disposed between the coil portion 300 and the body 100 to insulate the coil portion 300 from the body 100.

The insulating film 400 may include parylene, epoxy resin, polyimide resin, liquid crystal polymer resin, or the like, in a single form or in combined forms, but is not limited thereto.

The opening O may be formed in the insulating film 400 such that at least a portion of the lead-out patterns 321 and 322 and the body 100 contact each other. In this embodiment, the opening O may open a corner portion at which the second surfaces 321B and 322B among the second surfaces 321B and 322B of the lead-out patterns 321 and 322 are connected to the first surfaces 321A and 322A, to the body 100. As described above, since the second surfaces 321B and 322B of the lead-out patterns 321 and 322 may be formed in an L shape overall, in this embodiment, the opening O may be formed along the corner portion of the second surfaces 321B and 322B of the lead-out patterns 321 and 322, and may be formed in an L shape overall. As a result, as illustrated in FIGS. 3 and 4, the insulating film 400 may cover the coil patterns 311 and 312 and the support portion 210, and may be formed in only a portion of each of the lead-out patterns 321 and 322, the auxiliary lead-out patterns 331 and 332, and the end portions 221 and 222, and may be not exposed from the external surface of the body 100.

In a case of a thin film coil component, a plurality of coil portions having a form connected to each other on a relatively large substrate may be formed, and after trimming the substrate, an insulating film may be formed along surfaces of the substrate and the coil portion. Thereafter, the magnetic composite sheet may be stacked and cured on the relatively large substrate, and dicing may be performed along a connection portion between adjacent coil portions to manufacture a plurality of individual components. The insulating film may be also cut in a dicing process, due to ductility of the insulating film, and a phenomenon in which the insulating film stretches to surfaces of the individual components may occur. In this case, when the external electrode is formed on the surfaces of the components, the reliability for bonding between the external electrode and the coil portion may be lowered, and appearance defects may occur.

In this embodiment, to solve the above-described problem, an opening O may be formed in the insulating film 400 to expose portions from corner portions of the second surfaces 321B and 322B of the lead-out patterns 321 and 322. For example, the corner portions of the second surfaces 321B and 322B of the lead-out patterns 321 and 322 correspond to regions cut by a dicing blade, and the opening O may be formed by removing a portion of the insulating film 400 in the corresponding regions. As a result, the above-described problem caused by the insulating film 400 disposed in the corresponding regions during the dicing process may be solved.

The opening O may be formed in the insulating film 400 through a photolithography process, a drilling process, or a polishing process. For example, when the insulating film 400 may include a photosensitive insulating resin, the opening O may be formed in the insulating film 400 through the photolithography process. As another example, the opening O may be formed in the insulating film 400 through a laser drilling process. The laser drilling process may use a $CO_2$ laser, but is not limited thereto.

A surface roughness of the lead-out patterns 321 and 322 contacting the body 100 may be greater than a surface roughness of the lead-out patterns 321 and 322 covered by the insulating film 400. Since the surface roughness of the lead-out patterns contacting the body may be formed to be relatively high, the bonding force between the body 100 and the coil portion 300 may be improved. Referring to FIGS. 5 and 6, since the opening O exposes the corner portion of the second surface 321B of the first lead-out pattern 321 to the body 100, the corner portion of the second surface 321B of the first lead-out pattern 321 may contact the body 100. Therefore, the surface roughness of the corner portion of the second surface 321B of the first lead-out pattern 321 may be greater than a surface roughness of remaining portion of the first surface 321B contacting the body 100, to improve the bonding force between the first lead-out pattern 321 and the body 100.

In a case of using parylene as the insulating film 400, a surface in contact with the lead-out patterns 321 and 322 of the insulating film 400 may have a relatively good bonding force due to the properties of parylene, but a surface in contact with the body 100 including a resin may be a relatively weak bonding force. Therefore, in this embodiment, since the opening O may be formed to expose the corner portion of the second surface 321B of the first lead-out pattern 321 corresponding to the cut surface in the dicing process, the first lead-out pattern 321 and the body 100 may be configured to make contact near the cut surface. Therefore, delamination may be prevented from occurring at the boundary between the body 100 and the insulating film 400 due to stress generated in the dicing process. In addition, the surface roughness of the surface opened by the opening O of the surface of the first lead-out pattern 321 may be relatively high to improve the bonding force between the body 100 and the first lead-out pattern 321.

At the operating voltage of the coil component 1000 according to this embodiment, current may flow to the coil portion having a relatively low resistance, and thus, primarily does not affect the insulation characteristics of the body 100. Even when the magnetic material is pressed in contact with the lead-out patterns 321 and 322 during the forming process of the body 100 (stacking of magnetic composite sheet), an insulation coating film of about tens of nanometers to several micrometers may exist on a surface of the magnetic material (for example, the metal magnetic powder). Therefore, it may be very difficult to generate leakage current toward the body. For example, the insulation coating film may be formed of a material having a breakdown voltage (BDV) higher than an operating voltage of the coil component 1000 according to this embodiment. In this case, performance of the component may not be affected under a normal operating environment of the coil component 1000 according to this embodiment, even when the first lead-out pattern 321 and the body 100 are in contact with each other.

A surface roughness of a surface opened by the opening O, among the surfaces of the first lead-out pattern 321, may be formed when the opening O is formed. For example, when the opening O is formed in the insulating film 400 by the laser drilling process, the laser drilling process may be performed on a surface of the first lead-out pattern 321 formed by and exposed from the opening O (second surface 321B in this embodiment) to form a surface roughness on the surface of the first lead-out pattern 321. In the above description, although the surface of the first lead-out pattern 321 open to the body 100 by the opening O is described as having a relatively high surface roughness, it may also be expressed as a recess or a groove formed on the surface of the first lead-out pattern 321 open to the body 100 by the opening O.

The external electrodes 500 and 600 may be arranged to be spaced apart from each other on the one surface 106 of the body 100, and may be connected to the first and second lead-out patterns 321 and 322. The first external electrode 500 may be connected in contact with the first lead-out pattern 321 and the first auxiliary lead-out pattern 331, and the second external electrode 600 may be connected in contact with the second lead-out pattern 322 and the second auxiliary lead-out pattern 332.

The external electrodes 500 and 600 may electrically connect the coil component 1000 to a printed circuit board and the like, when the coil component 1000 according to this embodiment is mounted on the printed circuit board and the like. For example, the coil component 1000 according to this embodiment may be mounted such that the sixth surface 106 of the body 100 faces the upper surface of the printed circuit board. Since the external electrodes 500 and 600 may be arranged to be spaced apart from each other on the sixth surface 106 of the body 100, the connection portion of the printed circuit board may be electrically connected.

The external electrodes 500 and 600 may include at least one of a conductive resin layer and an electroplating layer. The conductive resin layer may be formed by printing a conductive paste on the surface of the body 100 and curing it. The conductive paste may include any one or more conductive metals selected from the group consisting of copper (Cu), nickel (Ni), and silver (Ag), and a thermosetting resin. The electroplating layer may include any one or more selected from the group consisting of nickel (Ni), copper (Cu), and tin (Sn). For example, the external electrodes 500 and 600 may include a first conductive layer 10 formed on the surface of the body 100 to directly contact the lead-out patterns 321 and 322 and the auxiliary lead-out patterns 331 and 332, and a second conductive layer 20 disposed on the first conductive layer 10, respectively. For example, the first conductive layer 10 may be a copper plating layer, or may be a cured conductive paste containing a resin and a metal powder. The second conductive layer 20 may be an electroplating layer including at least one of nickel (Ni) and tin (Sn). The second conductive layer 20 may include a nickel plating layer, and a tin plating layer disposed on the nickel plating layer.

Although not illustrated, the coil component 1000 according to this embodiment may further include an insulating film disposed in a region, other than regions in which the external electrodes 500 and 600 among the first to sixth surfaces 101, 102, 103, 104, 105, and 106 of the body 100 are formed. The insulating film may be an oxide film obtained by oxidizing a cut surface of the metal magnetic powder exposed from the first to sixth surfaces 101, 102, 103, 104, 105, and 106 of the body 100, stacking the insulating film including the insulating resin on the first to sixth surfaces 101, 102, 103, 104, 105, and 106 of the body 100, forming an insulating material on the first to sixth surfaces 101, 102, 103, 104, 105, and 106 of the body 100 by vapor deposition, or applying an insulation paste to the first to sixth surfaces 101, 102, 103, 104, 105, and 106 of the body 100 and curing it. As described above, the insulating film may include a metal oxide film, or may include an insulating resin such as epoxy. The insulating film may function as a plating resist in forming the external electrodes 500 and 600 by the electroplating process, but is not limited thereto.

Figure 7:
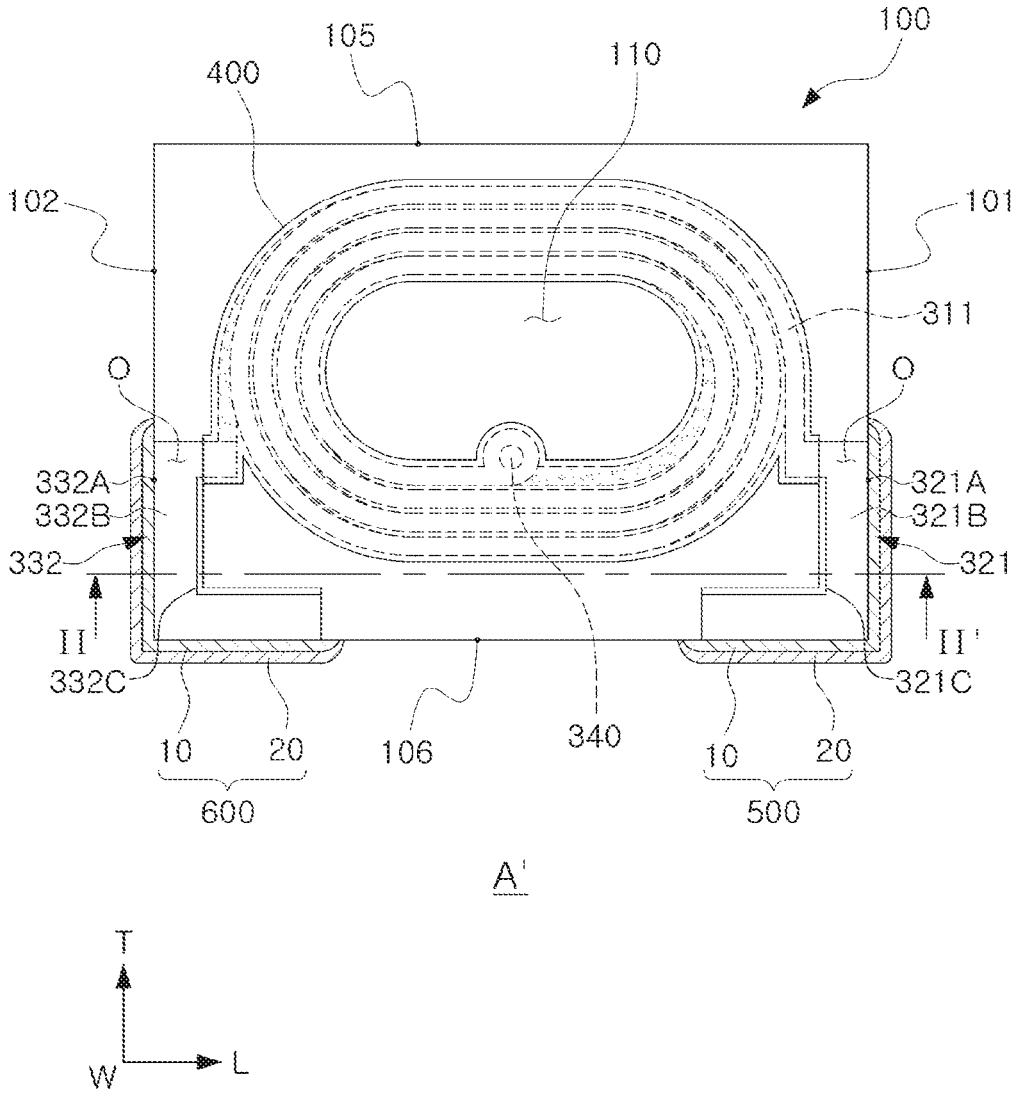
FIG. 7 is a view illustrating a modified embodiment of FIG. 1, when seen in a direction A.
Figure 8:
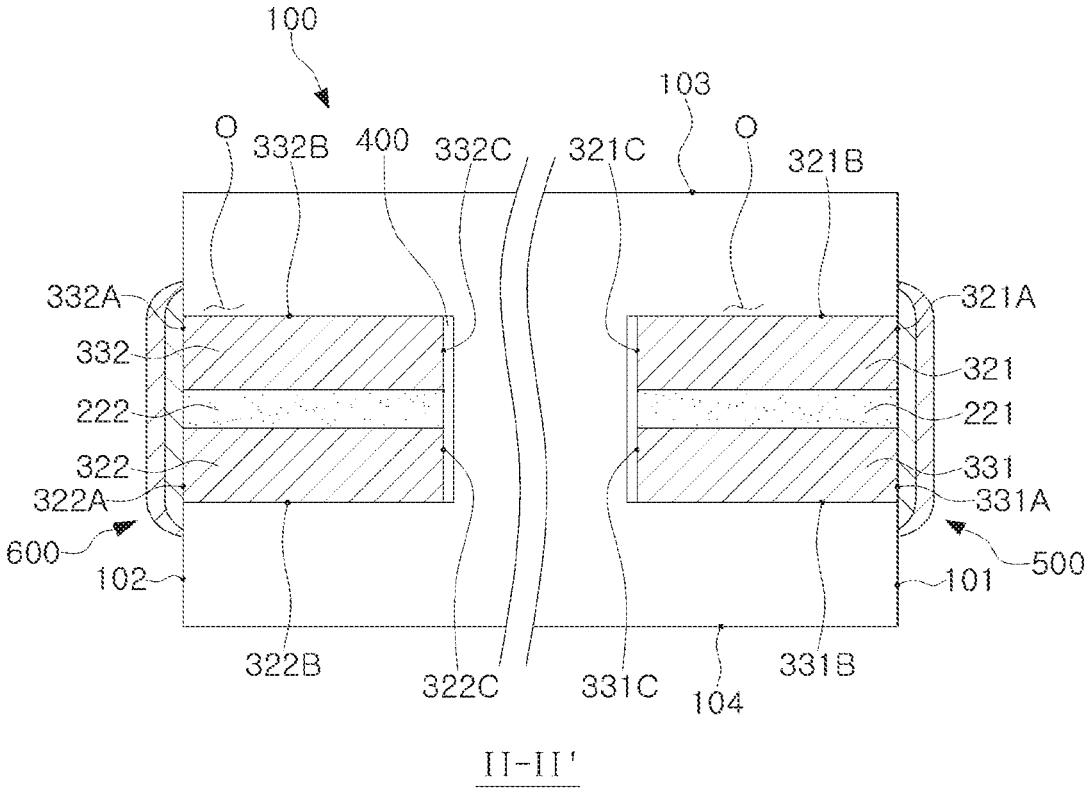
FIG. 8 is a cross-sectional view taken along line II-II' of FIG. 7.
Figure 9:
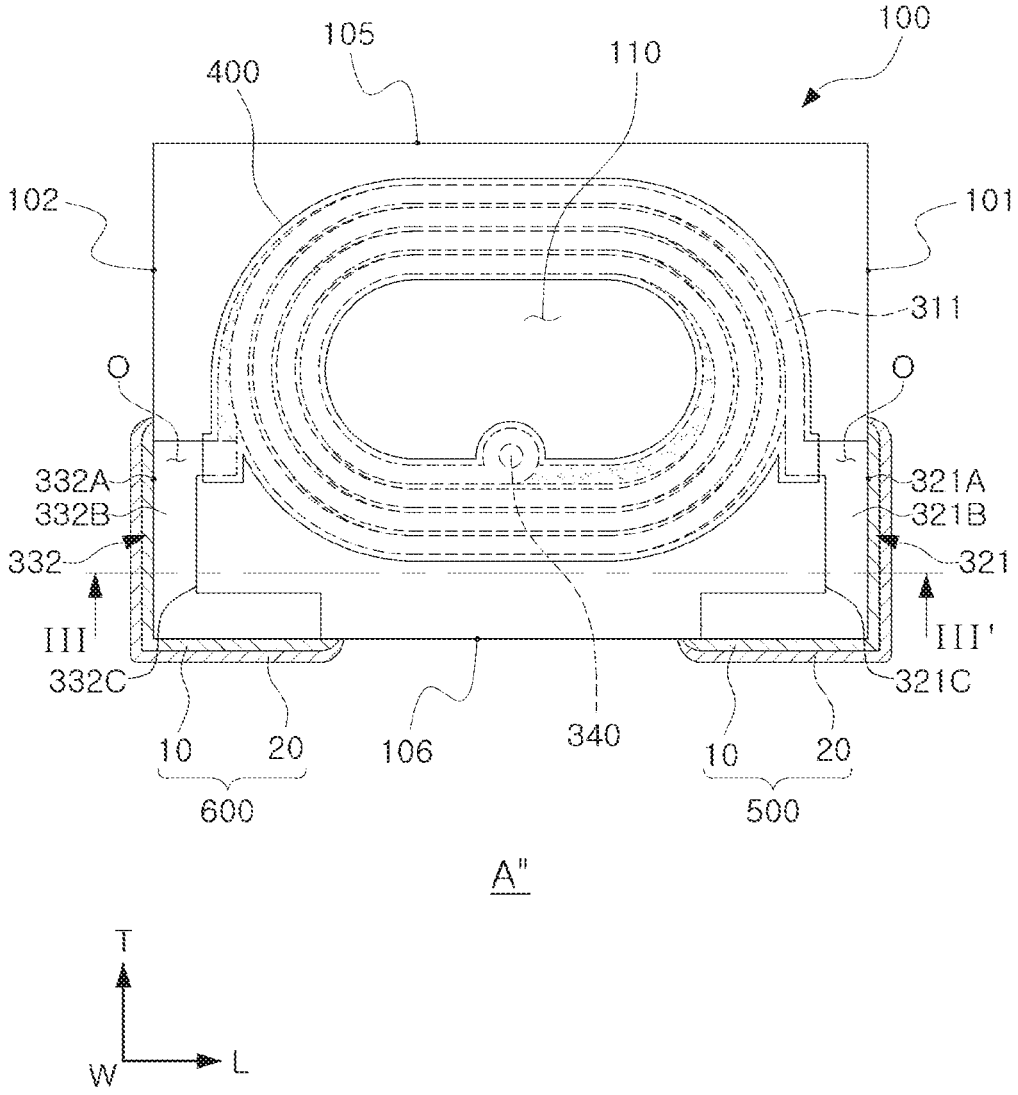
FIG. 9 is a view illustrating another modified embodiment of FIG. 1, when seen in a direction A.
Figure 10:
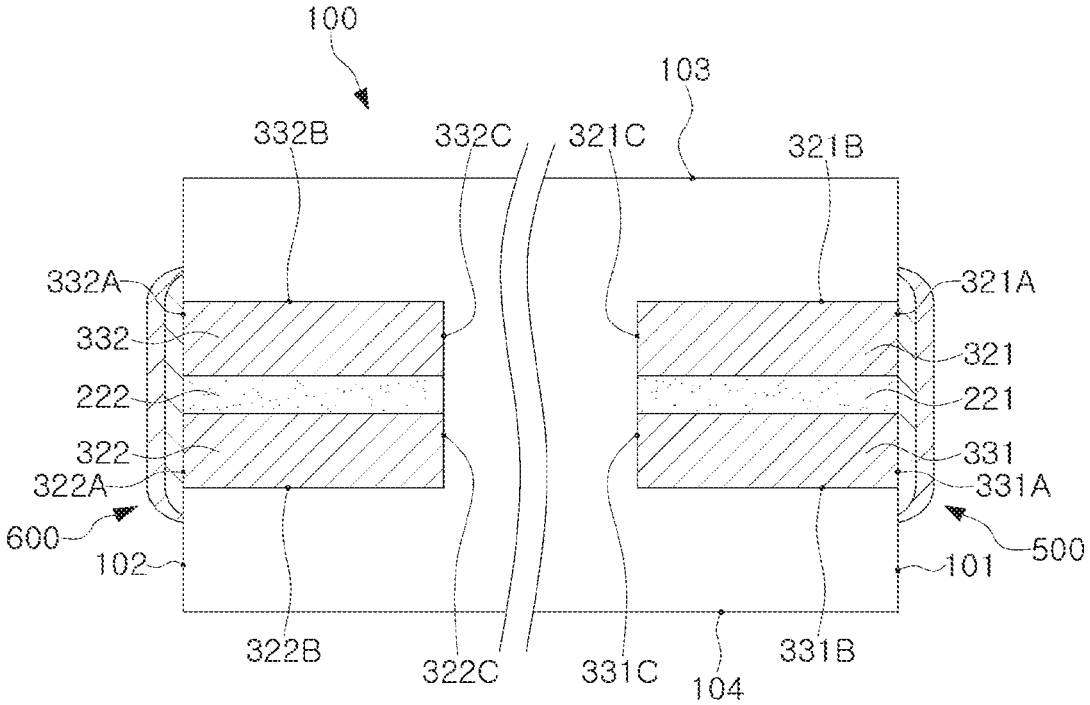
FIG. 10 is a cross-sectional view taken along line III-III' of FIG. 9.

FIG. 7 is a view illustrating a modified embodiment of FIG. 1, when seen in a direction A. FIG. 8 is a cross-sectional view taken along line II-II' of FIG. 7. FIG. 9 is a view illustrating another modified embodiment of FIG. 1, when seen in a direction A. FIG. 10 is a cross-sectional view taken along line III-III' of FIG. 9.

Referring to FIGS. 7 to 10, in a modified embodiment and another modified embodiment, a size and a position of an opening O formed in an insulating film 400 may be different.

Referring to FIGS. 7 and 8, in a modified embodiment, the entirety of a second surface 321B of a first lead-out pattern 321 may be open to a body 100. Therefore, the opening O may be formed on the entire second surface 321B of the first lead-out pattern 321, and the insulating film 400 may be formed only on a third surface 321C of the first lead-out pattern.

Although FIG. 8 discloses that the insulating film 400 is disposed on the entire third surface 321C of the first lead-out pattern, the scope of the present disclosure is not limited thereto, and the opening O may extend to a portion of the third surface 321C, to dispose the insulating film 400 only on a portion of the third surface 321C of the first lead-out pattern 321.

Referring to FIGS. 9 and 10, in another modified embodiment, the entirety of the second surface 321B and the third surface 321C of the first lead-out pattern 321 may be open to the body 100. As a result, the insulating film 400 may be formed to surround the coil patterns 321 and 322 and the support portion 210, but may be formed to not surround the lead-out patterns 321 and 322, the auxiliary lead-out patterns 331 and 332, and the end portions 221 and 222.

In the above description, the bonding relationship between the first lead-out pattern 321, the body 100, the insulating film 400, and the opening O has been mainly described based on the first lead-out pattern 321, but is for convenience of explanation. The above description may be applied to the second lead-out pattern 322 and the auxiliary lead-out patterns 331 and 332 in a similar manner.

According to the present disclosure, the reliability for bonding between the coil portion and the body may be secured.

While example embodiments have been illustrated and described above, it will be apparent to those skilled in the art that modifications and variations could be made without departing from the scope of the present disclosure as defined by the appended claims.

What is claimed is:

1. A coil component comprising:

a body;

a supporting substrate embedded in the body;

a coil portion including a coil pattern and a lead-out pattern exposed to an outside of the body through an external surface of the body, the coil portion being disposed on the supporting substrate and embedded in the body; and an insulating film disposed between the coil portion and the body and spaced apart from the external surface of the body, wherein at least a portion of the lead-out pattern contacts the body through an opening formed in the insulating film.

2. The coil component according to claim 1, wherein the lead-out pattern has a first surface exposed to the outside of the body through the external surface of the body, and a second surface connected to the first surface and disposed inside the body, and a corner portion of the second surface of the lead-out pattern, connected to the first surface of the lead-out pattern, is opened to an inner portion of the body through the opening.

3. The coil component according to claim 2, wherein the opening extends along the corner portion of the second surface of the lead-out pattern, and the insulating film is not exposed to the outside of the body.

4. The coil component according to claim 2, wherein an entirety of the second surface of the lead-out pattern is opened to the inner portion of the body.

5. The coil component according to claim 4, wherein the lead-out pattern further has a third surface connected to the second surface and opposing the first surface, wherein the opening extends from the second surface of the lead-out pattern to the third surface of the lead-out pattern, such that at least a portion of the third surface of the lead-out pattern is opened to the inner portion of the body.

6. The coil component according to claim 2, wherein the coil pattern comprises a first coil pattern disposed on a first surface of the supporting substrate, and a second coil pattern disposed on a second surface of the supporting substrate, the lead-out pattern comprises a first lead-out pattern disposed on the first surface of the supporting substrate and connected to the first coil pattern, and a second lead-out pattern disposed on the second surface of the supporting substrate and connected to the second coil pattern, and each of the first and second lead-out patterns is opened to the inner portion of the body through the opening.

7. The coil component according to claim 6, wherein the external surface of the body comprises a first surface, and a first end surface and a second end surface connected to each other through the first surface of the body and opposing each other, wherein the first lead-out pattern is exposed to the outside through the first surface of the body and through the first end surface of the body, and wherein the second lead-out pattern is exposed to the outside through the first surface of the body and the second end surface of the body.

8. The coil component according to claim 6, wherein the coil portion further comprises:

a first auxiliary lead-out pattern disposed on the second surface of the supporting substrate to correspond to the first lead-out pattern, and spaced apart from the second coil pattern; and a second auxiliary lead-out pattern disposed on the first surface of the supporting substrate to correspond to the second lead-out pattern, and spaced apart from the first coil pattern, wherein at least a portion of the first and second lead-out patterns and at least a portion of the first and second auxiliary lead-out patterns are opened to the inner portion of the body through the opening.

9. The coil component according to claim 8, wherein the first auxiliary lead-out pattern and the first lead-out pattern are connected to each other by a first connecting via penetrating through the supporting substrate, wherein the second auxiliary lead-out pattern and the second lead-out pattern are connected to each other by a second connecting via penetrating through the supporting substrate.

10. The coil component according to claim 1, wherein a surface roughness of a portion of the lead-out pattern contacting the body is greater than a surface roughness of a portion of the lead-out pattern covered by the insulating film.

11. A coil component comprising:

a body;

a supporting substrate embedded in the body;

a coil portion including a coil pattern, and a lead-out pattern exposed to an outside of the body through an external surface of the body, the coil portion being disposed on the supporting substrate and embedded in the body; and an insulating film disposed between the coil portion and the body, wherein the lead-out pattern has a first surface exposed to the outside of the body through the external surface of the body, and a second surface connected to the first surface and disposed inside the body, and the insulating film does not extend to a corner portion of the second surface of the lead-out pattern connected to the first surface of the lead-out pattern.

12. The coil component according to claim 11, wherein a surface roughness of a portion of the lead-out pattern contacting the body is greater than a surface roughness of a portion of the lead-out pattern covered by the insulating film.

13. A coil component comprising:

a body;

a supporting substrate embedded in the body;

a coil portion including a coil pattern, and a lead-out pattern exposed to an outside of the body through an external surface of the body, the coil portion being disposed on the supporting substrate and embedded in the body; and an insulating film disposed between the coil portion and the body, wherein the insulating film is disposed inside the body, and spaced apart from the external surface of the body.

14. The coil component according to claim 13, wherein the lead-out pattern has a first surface exposed to the outside of the body through the external surface of the body, and a second surface connected to the first surface and disposed inside the body, and a corner portion of the second surface of the lead-out pattern, connected to the first surface of the lead-out pattern, is opened to an inner portion of the body through an opening formed in the insulating film.

15. The coil component according to claim 14, wherein an entirety of the second surface of the lead-out pattern is opened to the inner portion of the body.

16. The coil component according to claim 15, wherein the lead-out pattern further has a third surface connected to the second surface and opposing the first surface, wherein the opening extends from the second surface of the lead-out pattern to the third surface of the lead-out pattern, such that at least a portion of the third surface of the lead-out pattern is opened to the inner portion of the body.

17. The coil component according to claim 14, wherein the coil pattern comprises a first coil pattern disposed on a first surface of the supporting substrate, and a second coil pattern disposed on a second surface of the supporting substrate, the lead-out pattern comprises a first lead-out pattern disposed on the first surface of the supporting substrate and connected to the first coil pattern, and a second lead-out pattern disposed on the second surface of the supporting substrate and connected to the second coil pattern, and each of the first and second lead-out patterns is opened to inner portion of the body through the opening.

18. The coil component according to claim 17, wherein the external surface of the body comprises a first surface, and a first end surface and a second end surface connected to each other through the first surface of the body and opposing each other, wherein the first lead-out pattern is exposed to the outside through the first surface of the body and through the first end surface of the body, and wherein the second lead-out pattern is exposed to the outside through the first surface of the body and the second end surface of the body.

19. The coil component according to claim 17, wherein the coil portion further comprises:

a first auxiliary lead-out pattern disposed on the second surface of the supporting substrate to correspond to the first lead-out pattern, and spaced apart from the second coil pattern; and a second auxiliary lead-out pattern disposed on the first surface of the supporting substrate to correspond to the second lead-out pattern, and spaced apart from the first coil pattern, wherein at least a portion of the first and second lead-out patterns and at least a portion of the first and second auxiliary lead-out patterns are opened to the inner portion of the body through the opening.

20. The coil component according to claim 13, wherein a surface roughness of a portion of the lead-out pattern contacting the body is greater than a surface roughness of a portion of the lead-out pattern covered by the insulating film.

* * * * *